US008272848B2

(12) United States Patent
Gentilin

(10) Patent No.: US 8,272,848 B2
(45) Date of Patent: Sep. 25, 2012

(54) POSITIVE-DISPLACEMENT RECIPROCATING COMPRESSOR

(75) Inventor: Giampaolo Gentilin, Trissino (IT)

(73) Assignee: Gentilin, s.r.l., Trissino (VI) (IT)

( * ) Notice: Subject to any disclaimer, the term of this patent is extended or adjusted under 35 U.S.C. 154(b) by 1002 days.

(21) Appl. No.: 11/655,914

(22) Filed: Jan. 22, 2007

(65) Prior Publication Data

US 2007/0116579 A1 May 24, 2007

(51) Int. Cl.
*F04B 53/00* (2006.01)
*F04B 53/14* (2006.01)
*F01B 9/00* (2006.01)

(52) U.S. Cl. ..... 417/234; 417/273; 92/140

(58) Field of Classification Search ..... 417/234, 417/271, 273; 92/140, 168; 123/54.1, 54.2
See application file for complete search history.

(56) References Cited

U.S. PATENT DOCUMENTS

| | | | | | |
|---|---|---|---|---|---|
| 1,820,883 | A | | 8/1931 | Hueber | 417/273 |
| 2,060,003 | A | * | 11/1936 | Decker | 417/273 |
| 2,246,074 | A | | 6/1941 | Joy | 91/493 |
| 2,598,271 | A | * | 5/1952 | Klosterman | 92/108 |
| 2,936,632 | A | | 5/1960 | Palmer | 91/493 |
| 3,418,937 | A | | 12/1968 | Cardillo et al. | 417/273 |
| 3,514,224 | A | | 5/1970 | Ludwig | 417/273 |
| 4,358,251 | A | * | 11/1982 | Gannaway | 417/319 |
| 4,459,945 | A | | 7/1984 | Chatfield | 123/55.3 |
| 4,512,291 | A | * | 4/1985 | Kirk | 123/54.2 |
| 5,152,678 | A | | 10/1992 | Zeck | 417/401 |
| 5,456,287 | A | | 10/1995 | Leu | |
| 5,573,386 | A | | 11/1996 | Schmitt et al. | 417/273 |
| 6,053,717 | A | | 4/2000 | Dixon | 418/122 |
| 6,729,225 | B2 | * | 5/2004 | Seo | 92/140 |
| 2001/0036410 | A1 | | 11/2001 | DeRuyter | |
| 2002/0009372 | A1 | | 1/2002 | Gruber et al. | |

FOREIGN PATENT DOCUMENTS

| | | |
|---|---|---|
| DE | 19501220 A1 | 7/1995 |
| EP | 1083334 A2 | 3/2001 |
| WO | WO 99/04141 | 1/1999 |

OTHER PUBLICATIONS

EP Search Report, Nov. 28, 2006.

* cited by examiner

*Primary Examiner* — Devon Kramer
*Assistant Examiner* — Philip Stimpert
(74) *Attorney, Agent, or Firm* — IP Strategies

(57) ABSTRACT

A positive-displacement reciprocating compressor, comprising a plunger slidingly coupled inside a cylinder, in which a compression chamber is located, and operatively connected to a motor which put it in motion inside the cylinder. The motor has a rotation shaft coupled with an eccentric cam mechanically connected to the plunger and able to impose longitudinal displacements to the plunger according to an orthogonal direction with respect to the rotation axis of the shaft.

18 Claims, 9 Drawing Sheets

POSITIVE-DISPLACEMENT RECIPROCATING COMPRESSOR

CROSS REFERENCE TO RELATED APPLICATION

This application claims benefit of Parent application Ser. No. 11/061,644, filed Feb. 22, 2005, hereby incorporated by reference in its entirety.

BACKGROUND OF THE INVENTION

The present invention is about a positive-displacement reciprocating compressor, suitable for being used in several applications, like for instance to feed spray guns or in tools of compressed air type, for performing blowing operations in machine shops, or other.

It is known that, to produce the compressed air required for performing operations like the painting of industrial products, for instance automobiles or earthmovers, positive-displacement reciprocating compressors are used, which compress variable air flow rates according to the use requirements.

Said compressors generally comprise a piston, or plunger, which, sliding inside a cylinder, compresses the air sucked from the surrounding environment for supplying it to one or more users at a higher pressure.

The piston performs a reciprocating motion inside the cylinder, according to an operation known for the man skilled in the art.

The movement of the piston is obtained through the so called "oscillating piston" mechanism, it too well known for the persons skilled in the art.

The compressed air produced by the compressor is usually stored in a tank for a subsequent utilization.

However, said compressors have some acknowledged inconveniences.

A first inconvenience is due to the fact that, for the intrinsic features of the "oscillating piston" mechanism, the sealing elements or gaskets coupled with said piston undergo stresses that cause a rather considerable wear degree.

This is due to the continuous irregular oscillation of the piston inside the cylinder, which causes an excessive rubbing of the sealing elements against the cylinder inner walls.

Consequently, maintenance or replacement interventions of the sealing elements are required, with the inevitable material and labour costs this involves.

A second inconvenience is due to the fact that, in order to limit the sealing elements wear, the oscillating piston performs an incomplete stroke inside the cylinder.

As a result, there is a lower production of compressed air, and thus lower efficiencies of the compressor with respect to the possible and expected ones.

A further inconvenience of the aforementioned compressors is due to their high constructional complexity.

Another inconvenience is due to the fact that the compressors according to the prior art described hereinbefore are not able to produce a continuous flow of compressed air when operated.

As is well known, this fact leads to undesired operative conditions, in which the compressed air exits intermittently from the compressor and the operation that it has to perform is performed in an imprecise and inadequate way.

To overcome the latter inconvenience, the compressors of known type are provided with a storage tank in which the compressed air is stored before being used.

The capacity of the tanks nowadays available on the market ranges from 25 to about 5000 liters, and thus there are several types of use, varying from hobbies to industrial utilization.

Only after the complete loading of these tanks, the compressed air is stably and readily available to the users.

The compressed air flow supplied by the compressor is thus made continuous and the optimal operative conditions to correctly perform the workings are obtained in use.

However, this solution of known type too has a first inconvenience due to the fact that the tanks considerably increase the overall dimensions of the compressors, this aspect being of particular relevance in those applications in which practical and easy manoeuvrability and handling of the compressor are required.

Another inconvenience is due to the danger related to the presence of the tank.

A further inconvenience is due to the need to produce more compressed air than that actually required at every use.

Indeed, when the compressor is stopped, it is required to refill the tank with its nominal flow rate to make efficient its subsequent use.

This involves an additional series of operations and an energy loss which could be avoided.

Not the least inconvenience is due to the fact that the arrangement of the tank further complicates the constructional shape of the compressors.

SUMMARY OF THE INVENTION

The present invention intends to overcome the aforementioned inconveniences.

In particular, the main object of the invention is to provide for a compressor in which the piston motion causes a lower wear degree of the sealing elements associated therewith with respect to that of equivalent known compressors.

It is a second object to improve the efficiency of positive-displacement compressors with respect to the prior art.

It is a further object of the invention to supply a continuous flow rate of stable compressed air to the users, simplifying the constructional shape of the compressor with respect to the known ones.

Said objects are obtained by a positive-displacement reciprocating compressor which, according to the content of the main claim, comprises at least a plunger, slidingly coupled inside a cylinder in which a compression chamber is obtained, and operatively connected to driving means able to put it in motion in said cylinder, and it is characterized in that said driving means comprise a motor having the rotation shaft coupled with eccentric means mechanically connected to said plunger and able to impose longitudinal displacements to said plunger according to an orthogonal direction with respect to the rotation axis of said shaft.

According to a preferred executive embodiment of the invention, the compressor comprises a shaped basement, which supports said piston and in which a collection chamber of the compressed air is obtained, said chamber being provided with at least an inlet for said compressed air in communication with said compression chamber of said cylinder, and at least an outlet for said compressed air in communication with the utilization.

Advantageously, the plunger motion inside the cylinder is an axial motion, being fully guided along the longitudinal axis of the cylinder in which it is contained.

This results in a minimum wear of the sealing elements interposed between the piston and the respective cylinder, increasing the working life of said elements with respect to what happens in the compressors of known type.

More advantageously, the axial movement allows the plunger to reach the end of stroke inside the cylinder, increasing the compressed air production and consequently the efficiency of the compressor with respect to the prior art ones.

Still advantageously, the compressor of the invention produces in use a more continuous compressed air flow with respect to the prior art, without requiring a tank of proper capacity coupled with the compressor.

Such aspect is furthermore improved by the arrangement of the collection chamber which, although generally being of reduced size, contributes to produce in use an almost continuous air flow rate.

As it will be better explained hereinafter, the collection chamber compensates, both at the switching on and in operative conditions, even the minimum compressed air supply intermittence.

Moreover, the collection chamber is rapidly refilled when the compressor is not operated: indeed, it is estimated that very few seconds are required to perform such operation.

In this way, the energy consumptions, related to the refill of stable compressed air inside the tank once the utilization is finished to be found in the compressors of known type with which the invention is comparable, are substantially eliminated.

All this is obtained without requiring storage tanks, as happens, on the other hand, in the prior art.

In this way, the overall dimensions and the constructional complexity of the compressor are considerably reduced with respect to the prior art.

Moreover, the handling, transport and arrangement of the compressor are improved in any situation.

Furthermore, in an advantageous way, the danger of the compressors is reduced with respect to those provided with a tank.

BRIEF DESCRIPTION OF THE DRAWINGS

The aforesaid objects and advantages, and others better specified in the following description, will be better highlighted in the description of a preferred executive embodiment of the invention, given in an explanatory and not limiting way, with reference to the figures of the annexed drawings, wherein.

DESCRIPTION OF THE INVENTION

Figure 1:
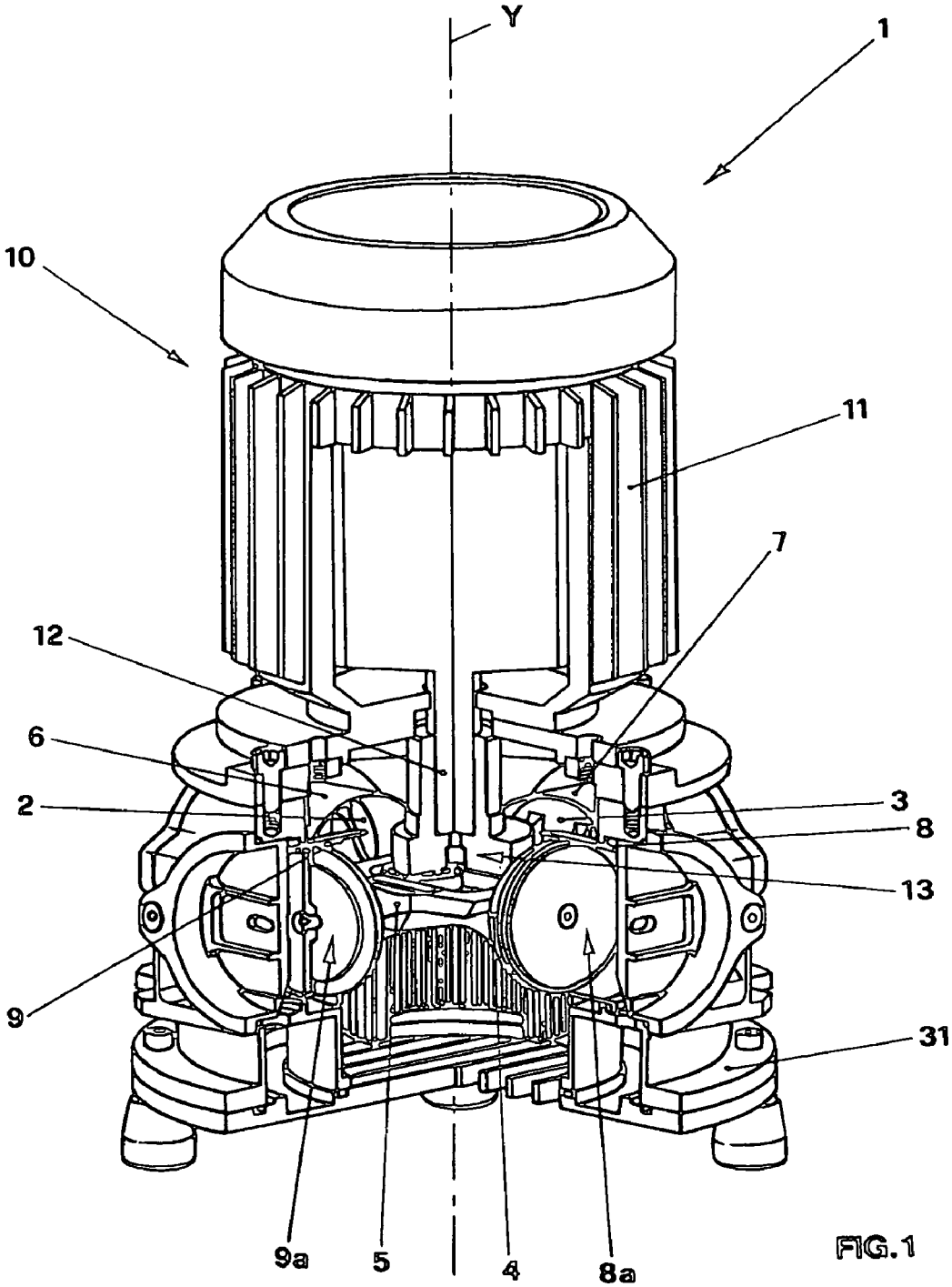
FIG. 1 is a partial sectional axonometric view of the compressor of the invention.

The positive-displacement reciprocating compressor of the invention is shown in FIG. 1, where it is generally indicated with numeral 1.

One can see that it comprises four plungers, indicated with numerals 2, 3, 4 and 5, slidingly coupled inside correspondent cylinders, indicated with numerals 6, 7, 8 and 9, in which a compression chamber is obtained, visible for the cylinders 8 and 9 only, where it is indicated with numerals 8*a* and 9*a*.

The plungers 2, 3, 4 and 5 are operatively connected to driving means, generally indicated with numeral 10, used to put them in motion in the respective cylinders 6, 7, 8 and 9.

According to the invention, the driving means 10 comprise a motor 11 having the rotation shaft 12 coupled with eccentric means, generally indicated with numeral 13, mechanically connected to the plungers 2, 3, 4, 5 and able to impose them longitudinal displacements according to an orthogonal direction with respect to the rotation axis Y of the shaft 12.

In FIG. 1 it is further evidenced that the positive-displacement compressor 1 comprises a shaped basement 31 which supports the plungers 2, 3, 4 and 5.

Figure 2:
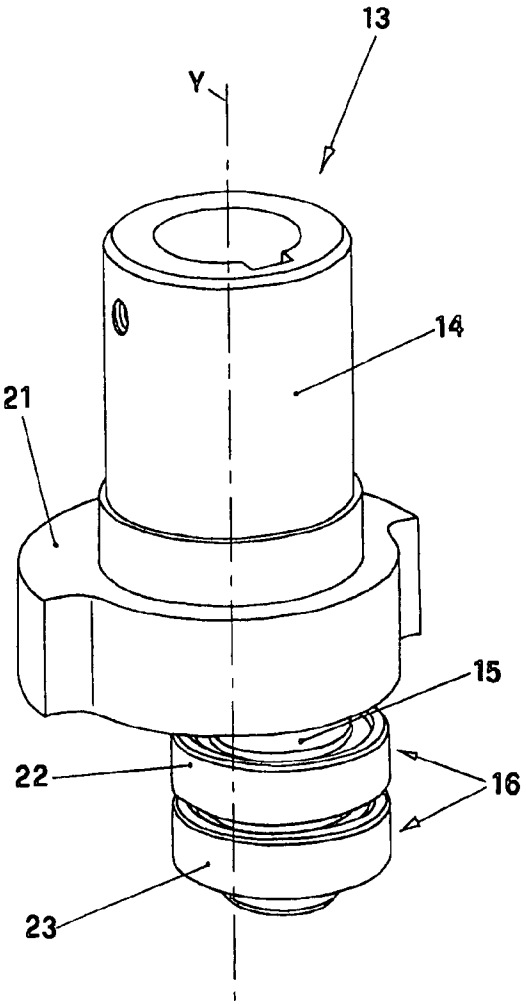
FIG. 2 is an axonometric view of a first detail of FIG. 1.

As shown in FIG. 2, the eccentric means 13 consist of a substantially longitudinally developed rotating body, in which a tubular portion 14 is obtained on one side, for the coupling to the shaft 12 according to systems well known for a man skilled in the art, like for instance a key coupling.

On the opposite side of the rotating body, an eccentric pin 15 is obtained, provided with bearing means, generally indicated with numeral 16, which, in this specific case and as better explained hereinafter, are arranged to cooperate with a profile 17, 18, visible starting from FIG. 3, obtained in a respective bracket 19, 20 which supports a pair of the plungers 2, 4 and 3, 5.

According to further executive embodiments of the invention, not shown in the drawings, the positive-displacement compressor could comprise a different number of plungers, as well as of the corresponding cylinders, said number varying with continuity from one to a higher number and being set by the manufacturer, depending upon the compressed air flow rate that has to be made available to the user and the constructional feasibility.

Therefore, different executive embodiments of the compressor of the invention can exist, comprising a plunger supported by a bracket, or a pair of mutually opposed and coaxial plungers supported by a single bracket, or still a pair of plungers mutually staggered at a right angle, supported by a respective bracket, and so on.

Still in FIG. 2 one can see that the rotating body is externally provided with a shaped sleeve 21, coaxial with the tubular portion 14, used to balance the weight of said tubular portion 14 with respect to the eccentric pin 15 during the rotation of the rotating body.

Figure 3:
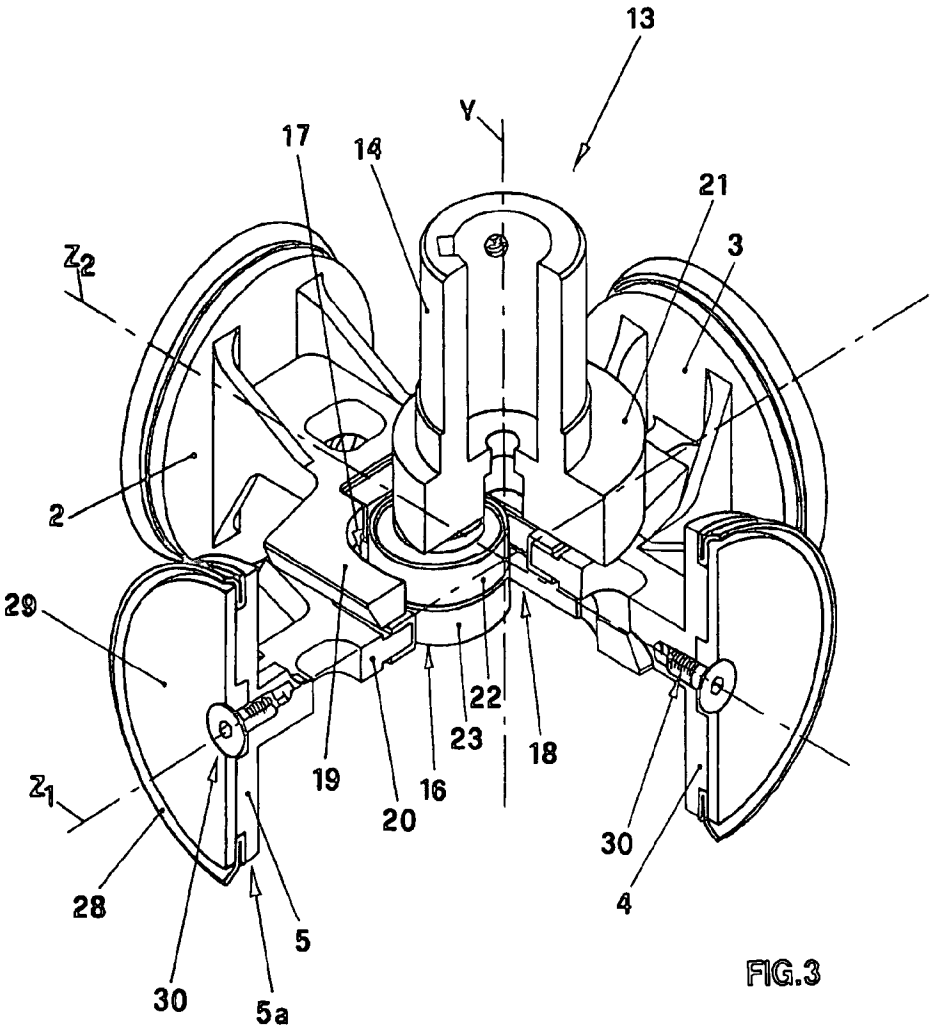
FIG. 3 is a partial sectional axonometric view of a second detail of FIG. 1.

FIG. 3 shows in detail that the first bracket 19 has the profile 17 and supports a first pair of mutually opposed and coaxial plungers 2, 4, while the second bracket 20 has the profile 18 and supports a second pair of mutually opposed and coaxial plungers 3, 5.

The contrast means 16 comprise a pair of cams 22, 23 mounted one above the other, coaxial to each other and to the eccentric pin 15.

The first cam 22 cooperates with the profile 17 of the first bracket 19, while the second cam 23 cooperates with the profile 18 of the second bracket 20.

Figure 4:
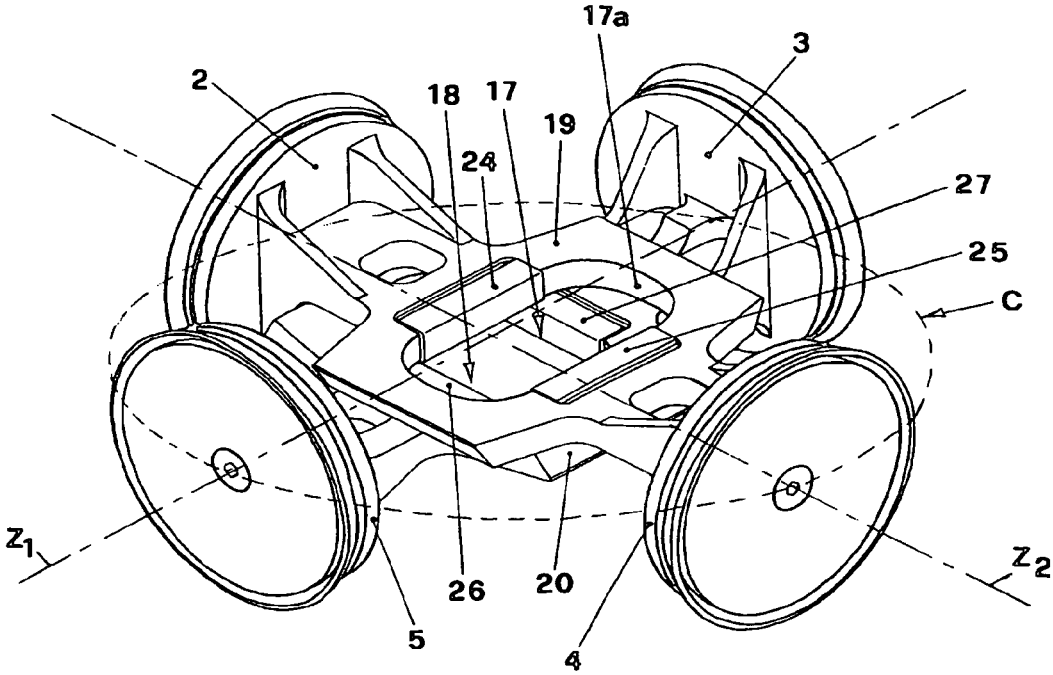
FIG. 4 is an axonometric view of a third detail of FIG. 1.

As one can see in FIG. 3, and better in FIG. 4, the profile 17, 18 which houses the bearing means 16 preferably but not necessarily consists of a through opening, but this constructional expedient is not binding with respect to the present invention, because the profile can have any kind of shape.

The first bracket 19 and the second bracket 20 are mutually orthogonally disposed and they slide one above the other to define a so called "star" constructional shape, well visible in FIGS. 3 and 4.

The longitudinal axis Z.sub.1, Z.sub.2, defined by the first and the second pair of plungers 2, 4 and 3, 5 respectively, lies on the sliding plane between the first bracket 19 and the second bracket 20, to dispose the center of each plunger 2, 3, 4, 5 on the same virtual circumference, indicated with C in FIG. 4.

FIG. 4 shows that each profile 17, 18 has a pair of mutually facing wearproof inserts 24, 25 and 26, 27, applied to the lateral edge 17*a*, 18*a* of said profile 17, 18.

In this case, said wearproof inserts 24, 25, 26, 27 are made of lapped steel, but, in other embodiments, they can be of a suitable material for this kind of component, like for instance Teflon.

The utilization of the above mentioned materials allows a proper contact between the bearing means 16 and the lateral edge 17*a*, 18*a* of each profile 17, 18 during the rotation of the rotating body, this aspect giving a good durability to the mechanical elements in reciprocal motion.

Figure 5:
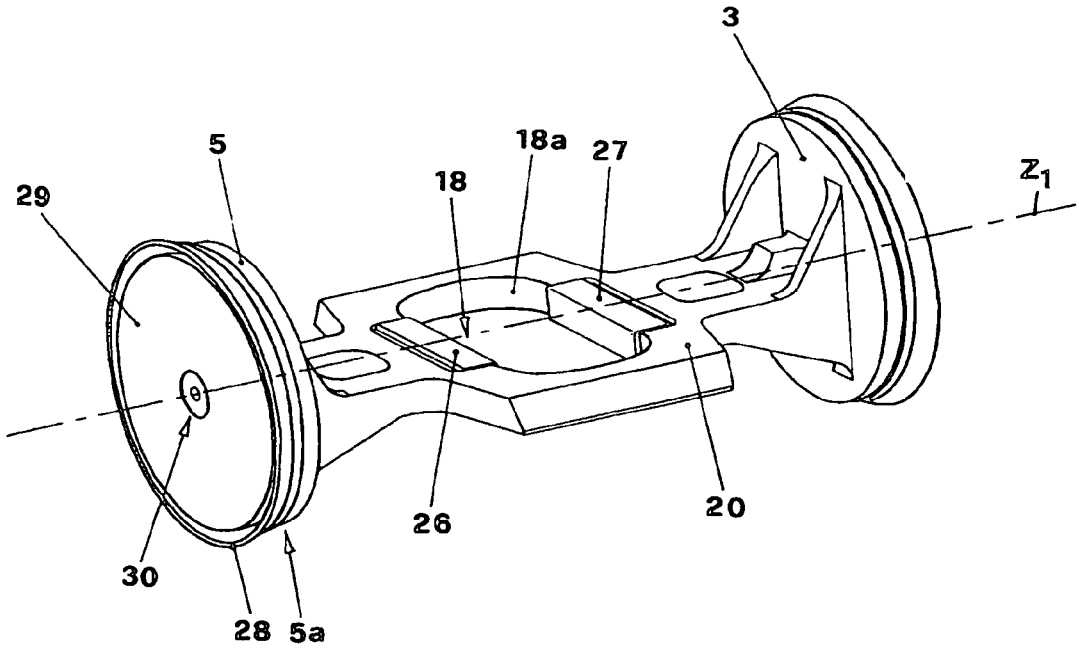
FIG. 5 is an axonometric view of a detail of FIG. 4.

In FIG. 5 one can see that the plunger 5 is provided with a perimetral sealing element 28, protruding from the lateral edge 5*a* of the plunger 5 and maintained steady in position by a covering disk 29 mounted in a depression obtained on the outer wall of the plunger 5.

The covering disk 29 is made integral with the plunger 5 through first fastening means, generally indicated with numeral 30 and of well known type, for example screws.

It is intended that what mentioned hereinbefore for the plunger 5 with reference to FIG. 5 is valid also for the other plungers 2, 3 and 4 belonging to the positive-displacement compressor 1.

Figure 6:
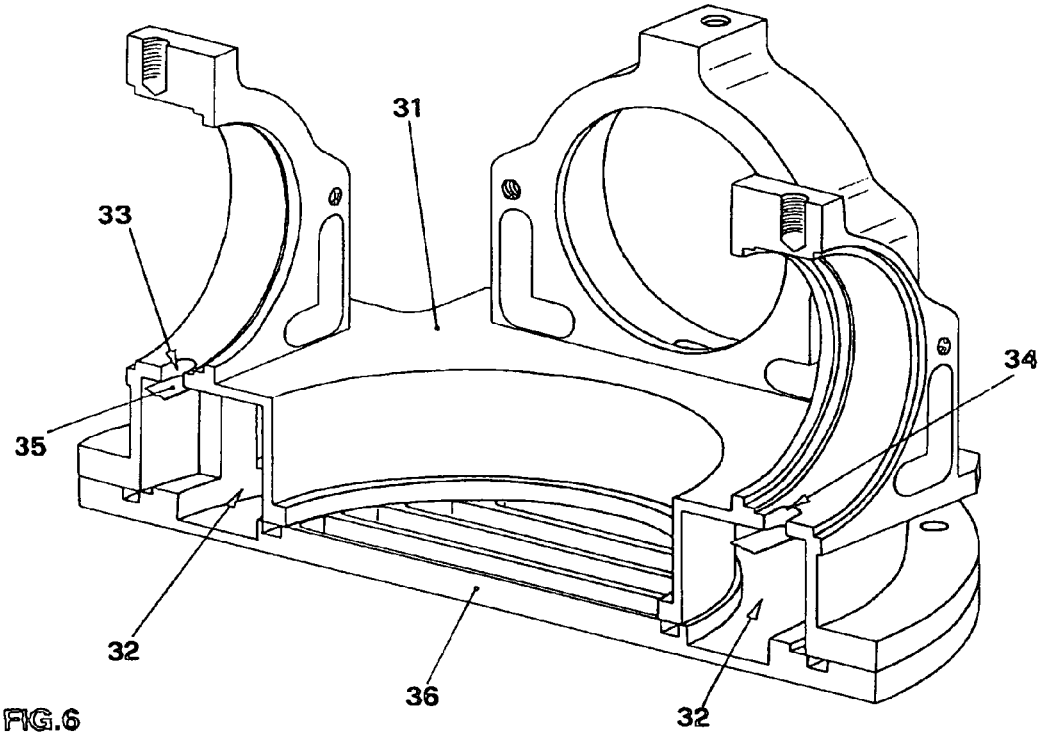
FIG. 6 is an axonometric view of a fourth detail of FIG. 1.
Figure 7:
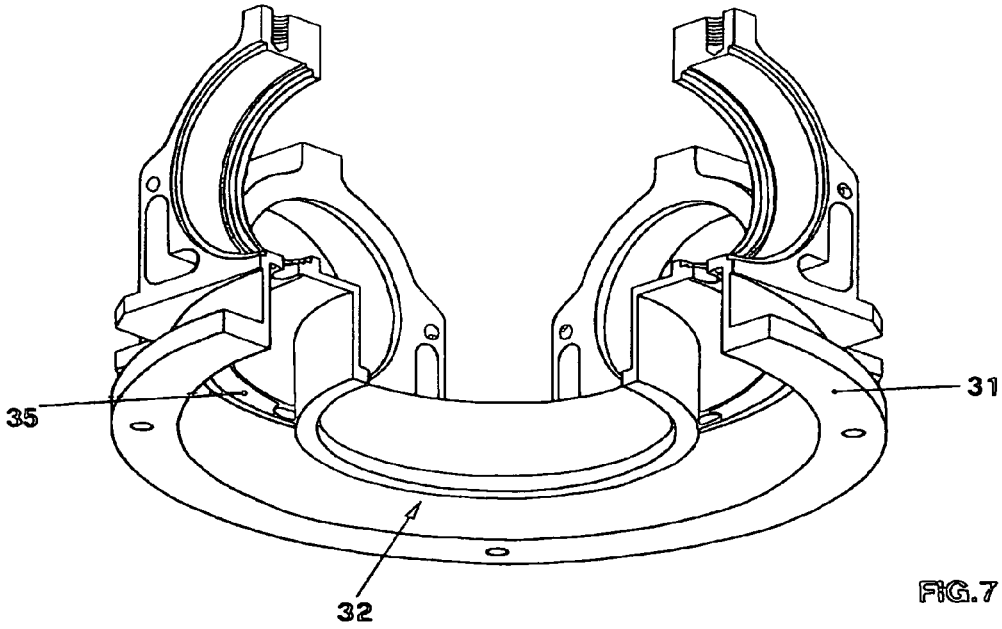
FIG. 7 is a bottom axonometric view of a detail of FIG. 6.

As shown in FIG. 6, according to the preferred executive embodiment of the invention described hereby, the compressor 1 comprises a collection chamber 32 for the compressed air, obtained in the aforementioned shaped basement 31 and provided with four compressed air inlets, of which only two, indicated with numerals 33 and 34, are visible.

The collection chamber 32 communicates with the compression chamber, of the kind previously indicated with numerals 8*a*, 9*a* in FIG. 1, belonging to each of the cylinders 6, 7, 8, 9.

The collection chamber 32 is furthermore provided with a compressed air outlet, not shown in the annexed drawings, in communication with the outside and preferably having an annular shaped profile.

Each inlet is provided with a valve 35 consisting of a steel made annular foil, whose shape evidently follows the shape of the collection chamber 32, thus being the only valve for each inlet.

Moreover, in operative conditions, as it will be better explained hereinafter, the valve 35 is opened at one of the plungers 2, 3, 4, 5 involved in the compression in that instant, while it is closed at one of the same plungers 2, 3, 4, 5, opposed to the previous one, which is sucking air in the same instant.

The shaped basement 31 is provided with a closure cap 36, applied thereon through connection means not shown in the drawings and of type known per se, for instance screws, which closes the collection chamber 32.

The arrangement and the shape of the collection chamber 32 are rather useful and effective for providing, in use, even more stable compressed air in a continuous way.

Indeed, if the sequential movement of the plungers 2, 3, 4, 5 provides for an almost optimal compressed air flow on one side, at least more continuous with respect to equivalent compressors of known type, an even minimum intermittence at the compressed air outlet remains on the other side, said intermittence being compensated in an optimal way by the collection chamber 32.

As it will be explained hereinafter, the combination of the plungers 2, 3, 4, 5 action with the collection chamber 32 provides, in use, for optimal operative conditions of the compressor 1, because the air flow rate is continuous, fluid and stable.

Figure 8:
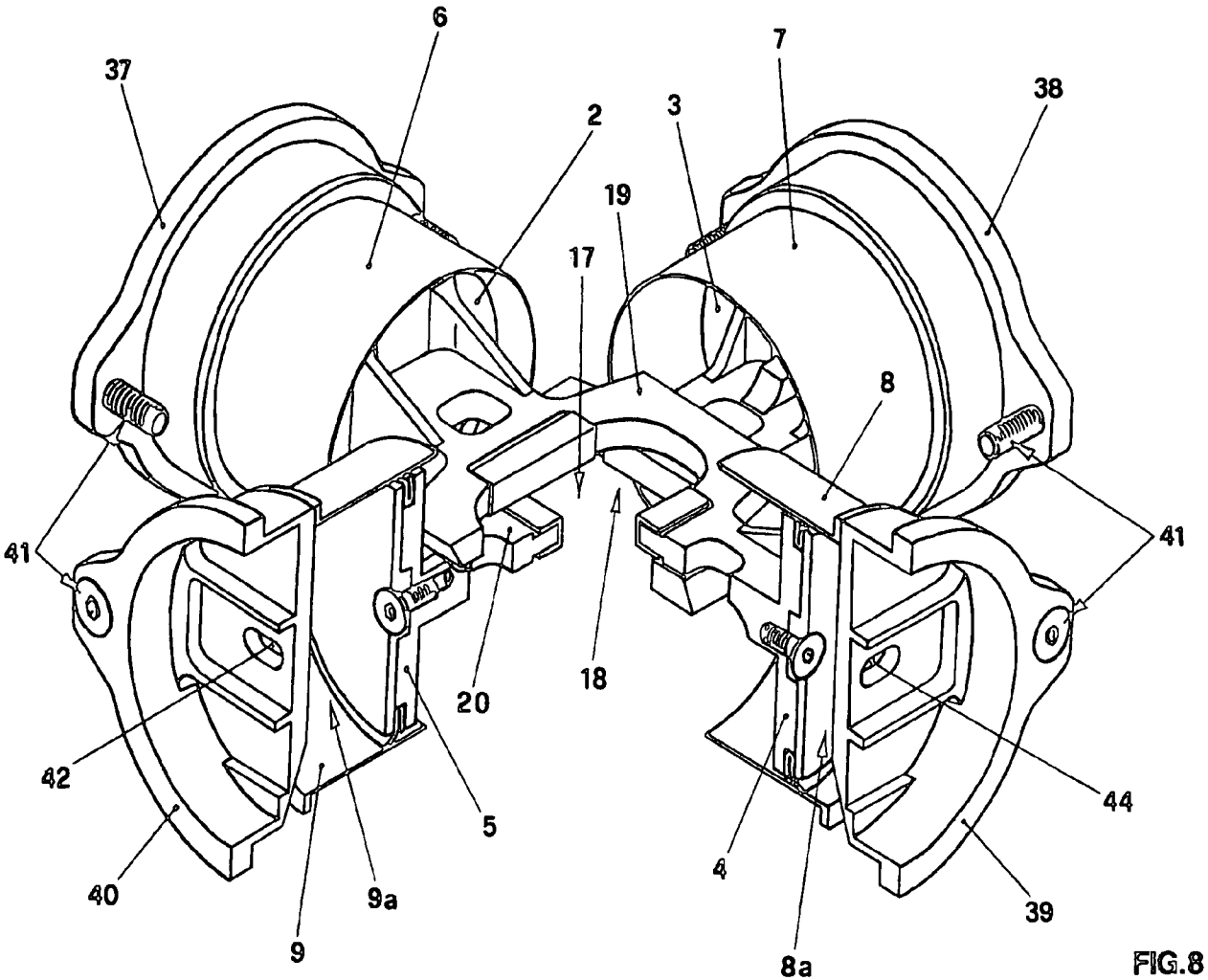
FIG. 8 is a partial sectional axonometric view of a fifth detail of FIG. 1, without eccentric means.

FIG. 8 shows that the compressor 1 comprises four heads, generally indicated with numerals 37, 38, 39 and 40, each externally applied to a portion of the shaped basement 31 through second fastening means, generally indicated with numeral 41, to be disposed to cover the respective cylinders 6, 7, 8 and 9.

Each head 37, 38, 39 and 40 has two through holes, partially visible in FIG. 8 for the heads 39 and 40, where they are indicated with numerals 42 and 44 respectively, and predisposed for sucking the air to be compressed inside the cylinders 6, 7, 8 and 9.

Figure 9:
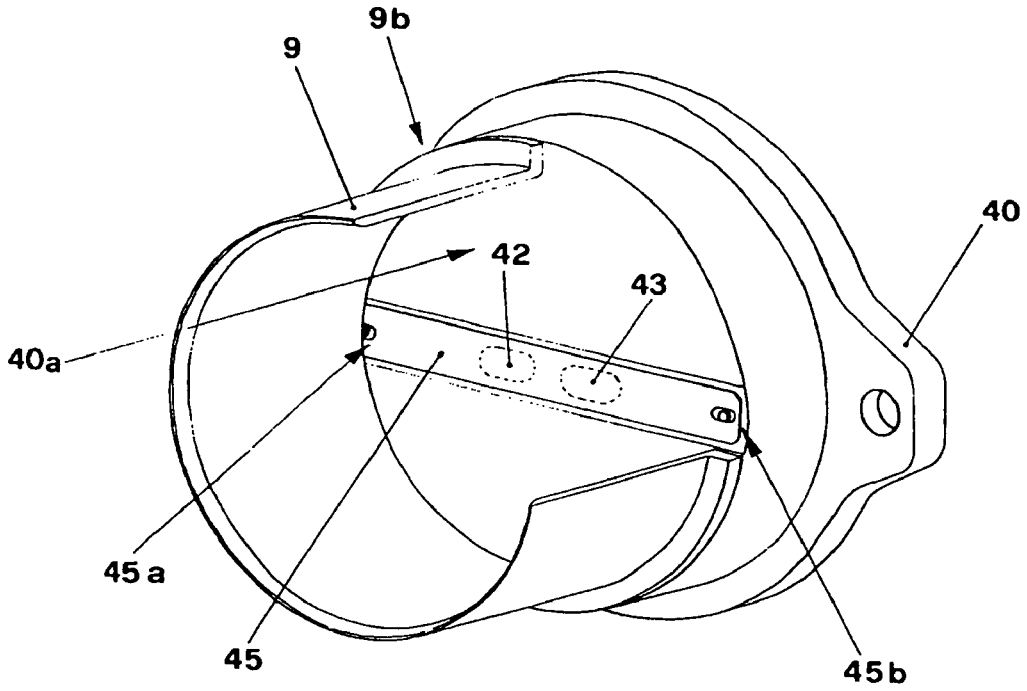
FIG. 9 is an axonometric view of a detail of FIG. 8 in an operative condition, i.e. during the compression stroke.
Figure 10:
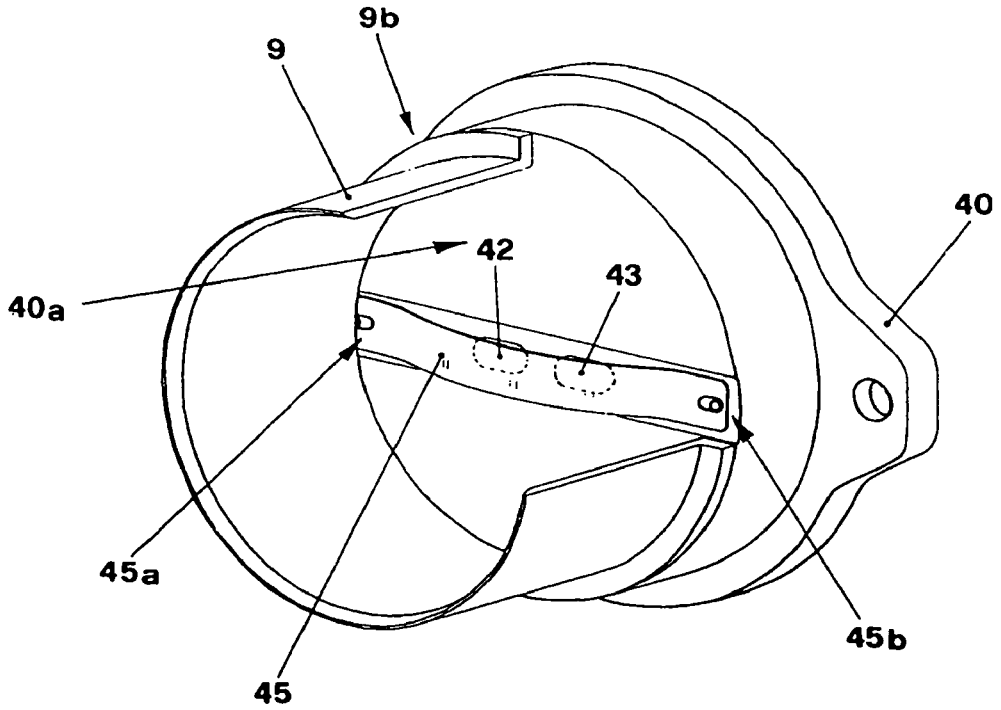
FIG. 10 is an axonometric view of the detail of FIG. 9 in another operative condition, i.e. during the induction stroke.

The subsequent FIGS. 9, 10 precisely show this particular constructional detail, with reference to the head 40 only, being intended that the other heads 37, 38 and 39 too are provided with the same characteristics.

In the aforementioned Figures, the two through holes, through which the air to be compressed is sucked, are indicated with numerals 42 and 43.

The compressor 1 comprises a flexible thin blade 45, preferably made of steel, coupled with the inner wall 40*a* of the head 40, the inner wall 40*a* being turned toward the corresponding cylinder 9.

The flexible thin blade 45 is blocked at the ends 45*a*, 45*b* by placing the peripheral edge 9*b* of the cylinder 9 close to the head 40.

The flexible thin blade 45 is disposed near the through holes 42, 43, to close them during the compression stroke and to open them during the induction stroke.

For this purpose, the flexible thin blade 45 is provided at the ends 45*a*, 45*b* with a pair of slots which are coupled with a respective pin applied to the inner wall 40*a* of the head 40.

During the induction stroke, the flexible thin blade 45 is bent toward the interior of the cylinder 9, substantially detaching from the inner wall 40*a* of the head 40 for most part of its length and remaining coupled therewith at the ends 45*a*, 45*b* only.

This is allowed because the slots obtained at the ends 45*a*, 45*b* of the flexible thin blade 45 slidingly hold the respective pins for a portion sufficient to uncouple said thin blade 45 from the inner wall 40*a* of the head 40, thus allowing the air to enter the cylinder 9.

It is evident that such an air suction system is very simple to manufacture, since it does not require those fastening means usually employed in the prior art to mutually couple this kind of constructional details of the compressor.

Figure 12:
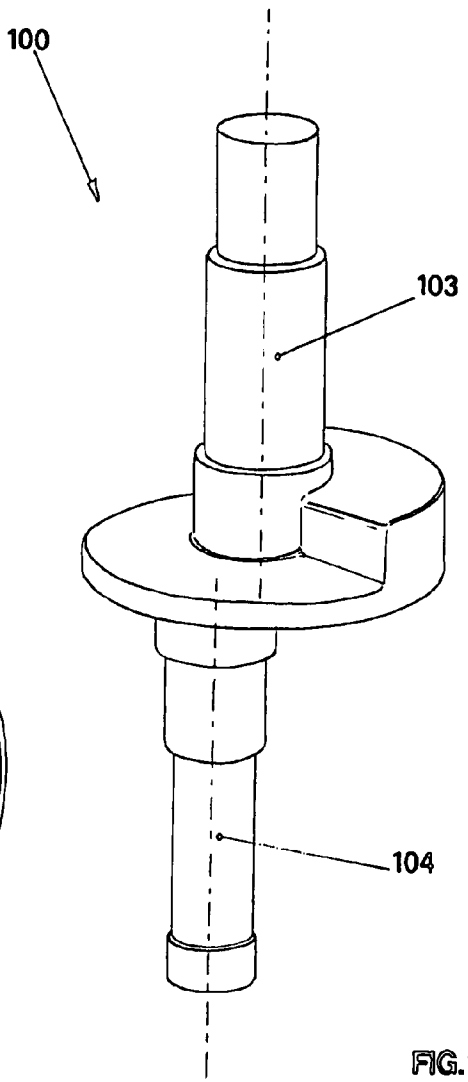
FIG. 12 is an axonometric view of a first detail of FIG. 11.
Figure 11:
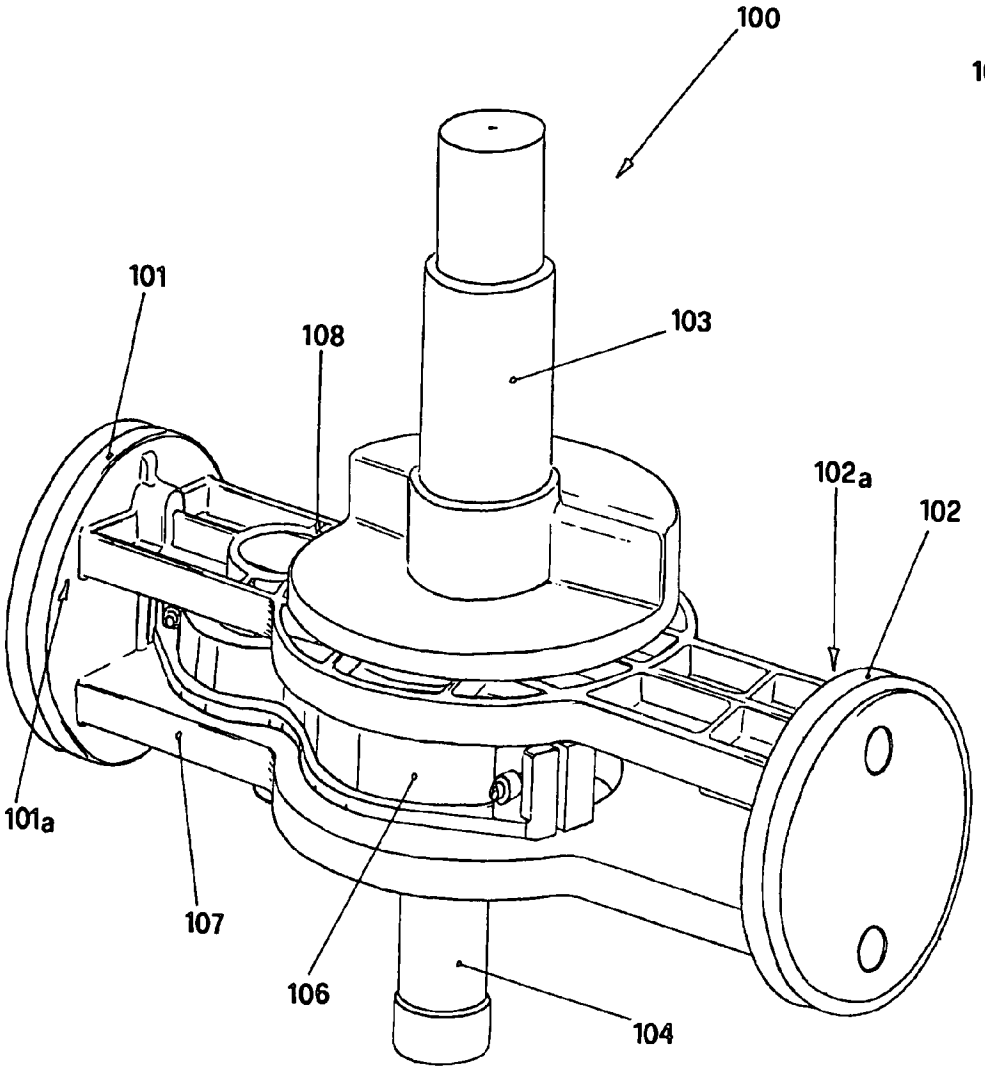
FIG. 11 is an axonometric view of a different embodiment of the detail of FIG. 3.

In FIG. 11 an example of a different executive embodiment of the invention is shown, in which the positive-displacement reciprocating compressor is different from that previously described because the contrast means, generally indicated with numeral 105, coupled with the eccentric pin 104 of the eccentric means 100, said eccentric pin 104 being better visible in FIG. 12, cooperate with a connecting rod 106 fastened to a lower bracket 107 and an upper bracket 108 which support a pair of mutually opposed and coaxial plungers 101, 102.

The lower bracket 107 and the upper bracket 108 are mutually parallel and spaced, coupled with the plungers 101, 102 at their peripheral edge 101*a*, 102*a*.

Figure 13:
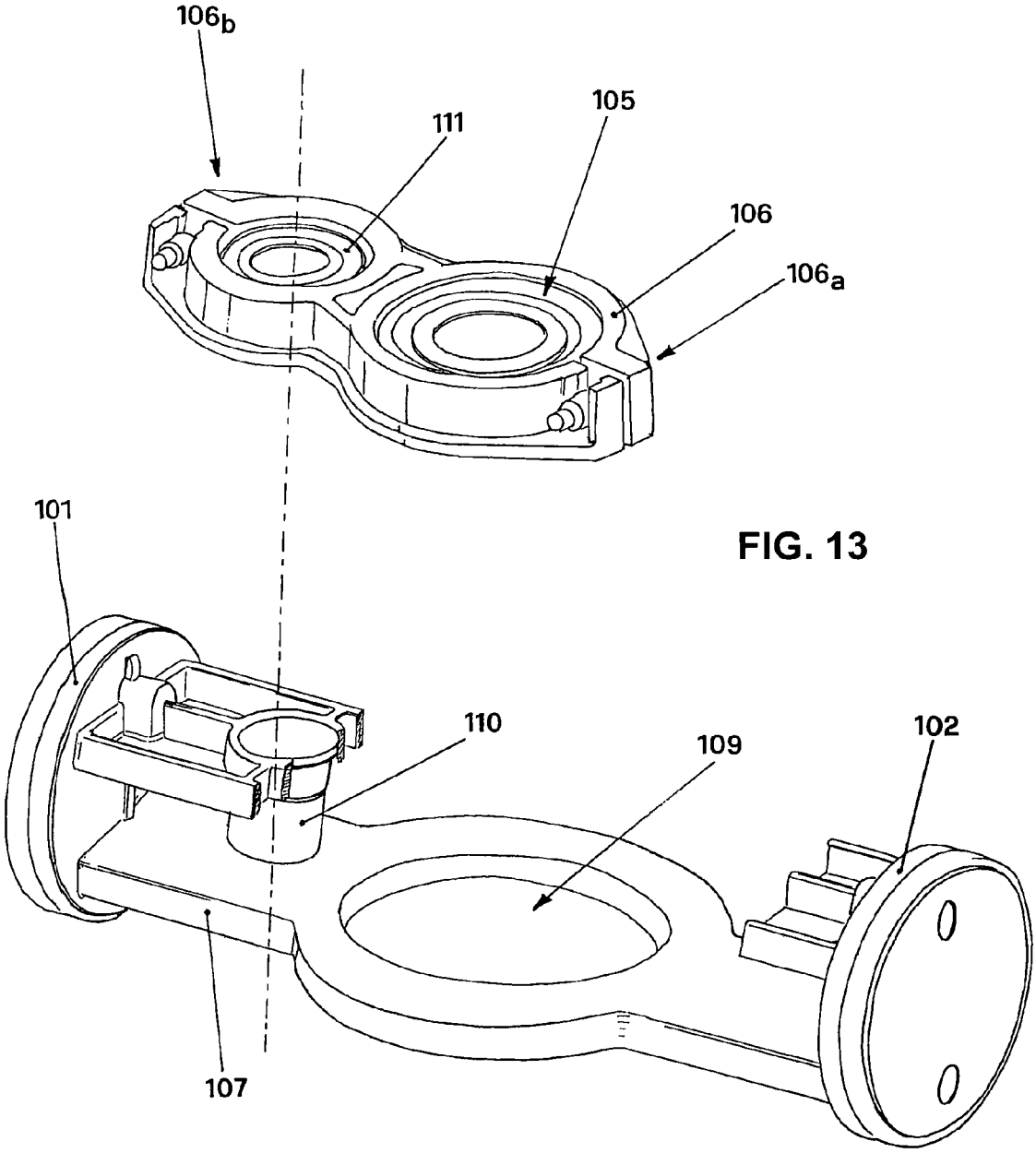
FIG. 13 is an exploded axonometric view of a second detail of FIG. 11.

FIG. 13 shows that the head 106*a* of the connecting rod 106 is engaged with a through opening 109 obtained on the lower bracket 107, while the small end 106*b* of the connecting rod 106 is coupled with a pin 110, connected to the lower bracket 107 and the upper bracket 108, through the interposition of a ball bearing 111.

Therefore, in this case, the rotation movement of the shaft 103 and the eccentric pin 104 associated therewith is transformed in a reciprocating rectilinear movement of the plungers 101, 102 through a mechanism known in technical language as "crank-handle connecting-rod assembly".

Figure 14:
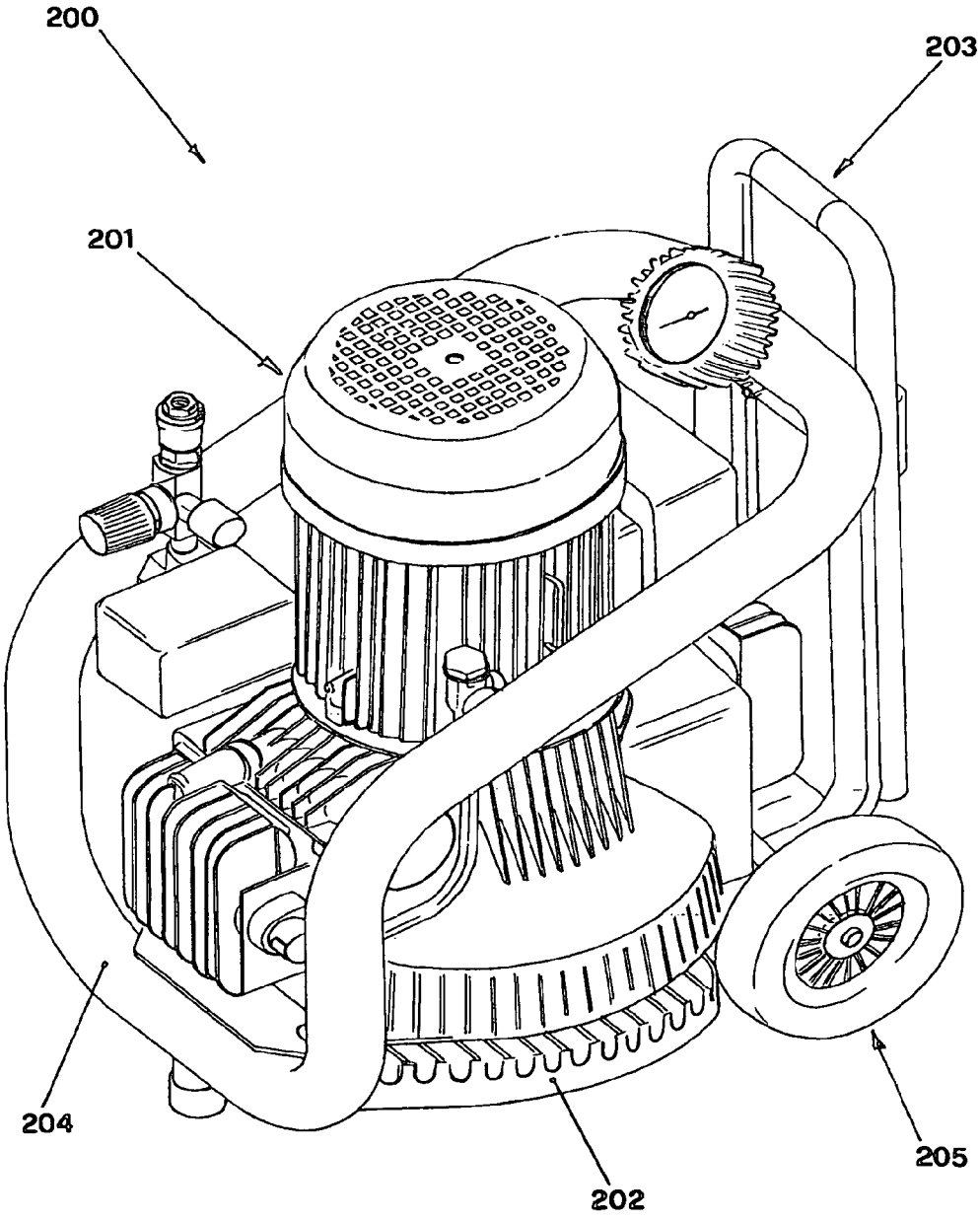
FIG. 14 is an axonometric view of a different executive embodiment of FIG. 1.

The subsequent FIG. 14 shows another embodiment of the invention, in which the positive-displacement compressor, generally indicated with numeral 200, comprises handle means 203 available to the user, joined to the shaped basement 202.

In the compressor 200, the collection chamber 204 of the compressed air consists of a tubular structure which externally limits and protects the driving means 201 and the shaped basement 202.

In this case, the compressor 200 also comprises two wheels, joined to the shaped basement 202, only one of said wheels, indicated with numeral 205, being visible in the figures, for its practical handling by the user.

Operatively, the driving means 10 put in motion the eccentric means 13 coupled with the bracket 19, 20, on which the plungers 2, 4 and 3, 5 are mounted in pairs and mutually opposed.

Now it is assumed, for instance, that the eccentric means 13 initially put in motion the plunger 2 inside the profile 17 of the bracket 19, said plunger performing in such way the air compression stroke in the cylinder 6.

Then the plunger 4, diametrically opposed and integral with the plunger 2, simultaneously starts the induction stroke, sucking air inside the cylinder 8.

The latter stroke is allowed by the fact that the flexible thin blade, not visible but of the type indicated with numeral 45, is almost fully moved away from the inner wall of the head 39 during the induction stroke, letting the air enter through the two through holes, only one of which being visible and indicated with numeral 44.

The plunger 3, adjacent to the plunger 2 and disposed with its longitudinal axis Z.sub.2 orthogonal to the longitudinal axis Z.sub.1 of said plunger 2, because of the movement of the eccentric means 13 inside the profile 18 of the bracket 20, starts to compress small air flow rates inside the cylinder 7 even before the plunger 2 has completed its compression stroke in the cylinder 6.

Similarly to what explained hereinbefore for the plunger 4, while the plunger 3 starts to compress air, the plunger 5, integral therewith and diametrically opposed, sucks a small air quantity inside the cylinder 9. In this way, when the plunger 2 has finished its compression action, the plunger 3 adjacent therewith has already started to compress its own air quantity.

In a sequential and uninterrupted manner, the eccentric means 13 will subsequently put in motion the plungers 4 and 5 so that they will contribute to produce compressed air.

It is evident that, while the plungers 4, 5 will compress air, although in a different quantity one respect to the other, the plungers 2 and 3 respectively opposed thereto will suck air in their turn, always according to different flow rates.

The operation described hereinbefore will continue indefinitely according to the need, with the plungers 2, 3, 4, 5 motion regulated by the rotation speed of the motor 11 shaft 12.

The operation of the positive-displacement reciprocating compressor shown in FIGS. 11 to 13, is almost equivalent with respect to that previously explained for the compressor 1, with the only exception that the longitudinal motion of the plungers 101, 102 is obtained through a mechanism known as "crank-handle connecting-rod assembly".

It is thus assured a continuous production of compressed air, without idle times, which considerably reduces, in use, the intermittence in the compressed air delivery, this aspect, as well known, causing inadequate and undesired operative conditions.

This is obtained through the axial operation of the plungers 2, 3, 4, 5 or 101, 102 by the driving means 10, considerably reducing, with respect to known compressors, the wear of the sealing elements of the type indicated with numeral 28, interposed between the plungers 2, 3, 4, 5 or 101, 102 and the respective cylinders 6, 7, 8, 9.

Consequently, the plungers 2, 3, 4, 5 or 101, 102 are allowed to move until their end of stroke, this aspect being instead prevented in the oscillating piston system compressors by the excessive wear of the sealing elements in the same conditions.

It is thus achieved the object to produce greater air flow rates with the same constructional solutions, increasing by extension the efficiency of the compressor with respect to the equivalent prior art.

Moreover, the lower wear of the sealing elements leads to less frequent repairing, maintenance or replacement interventions with respect to the prior art, with the evident advantages in terms of costs that this involves.

It is important to note that the above is obtained with a compressor of simple design and compact size that lead to extremely practical use conditions, in some applications.

Furthermore, the compressor of the invention supplies, in use, the actually required compressed air flow rate, without needing to maintain it working to restore the nominal capacity of a compressed air storage tank, as happens instead in the prior art.

The compressed air produced by each plunger 2, 3, 4, 5 is thus sent from the respective compression chamber to the collection chamber 32, and from here to its use destination.

The collection chamber 32 does not have a considerable size, but it is able to compensate temporary anomalies which can occur during the compressor 1 operation, especially in the initial phases.

Furthermore, the air inside the collection chamber is refilled in few seconds, depending on the compressor size, said air being thus stable and making the compressor immediately ready to be used in its subsequent switching on.

It is thus evident that, once finished the use of the positive-displacement compressor, few energy is sufficient to restore its ideal conditions for a subsequent use, lower, in any case, than the energy required by the known compressors provided with tank.

A number of other advantages with respect to the known compressors is related to the presence of the collection chamber 32.

First of all, the compressor of the invention assures stable and continuous compressed air flows even without requiring to provide for a compressed air storage tank, which is typical of the equivalent known embodiments.

Consequently, the constructional complexity and the overall dimensions of the positive-displacement compressor are further reduced, the latter aspect leading to better handling and transport conditions in any situation.

The fact that the removal of the tank provides for greater safety conditions, because explosion dangers are reduced, has to be considered too.

Obviously, the manufacturer could modify the plungers diameters to set the compressed air flow rate produced according to the customers' requirements and the operative conditions.

However, this is independent of the fact that the positive-displacement compressor of the invention provides for continuous and stable flow rate conditions for any application.

It is still evident that the compressor of the invention could be provided with feet and handles which make easy its transport and positioning even in standing position, this fact not being allowed at present by the compressors provided with tanks.

Therefore, on the basis of the aforesaid description, it should be understood that the positive-displacement reciprocating compressor of the invention achieves all the aforementioned objects and advantages.

Modifications and variations to the positive-displacement compressor of the invention could be introduced in the executive stage, consisting for instance in a different number of plungers moved by driving means to obtain the desired air flow rates.

It is evident that this could be made according to the use condition, contemporarily acting on the diameter of the plungers.

Otherwise, to obtain an ideal flow, the manufacturer could indefinitely increase the number of plungers.

Furthermore, the arrangement of the compression chamber with respect to the plungers could be different from that described hereinafter; for instance, it could be positioned between the pistons, and not below them.

All the described and cited embodiments, but not shown in the annexed figures of drawings, if they fall within the scope of protection of the following claims, should be intended as protected by the present patent.

The invention claimed is:

1. A positive-displacement reciprocating compressor, comprising:

a plunger adapted to slidingly couple inside a cylinder, to form a compression chamber within the cylinder, an upper bracket and a lower bracket supporting the plunger, a piston pin, connected between and spacing the upper bracket and the lower bracket, a driving element, operatively coupled to the plunger so as to be able to put the plunger in motion in said cylinder, wherein said driving element includes a motor having a rotation shaft coupled with an eccentric element mechanically connected to said plunger and able to impose longitudinal displacements to said plunger according to an orthogonal direction with respect to the rotation axis of said shaft, said eccentric element having a substantially longitudinally developed rotating body, having a tubular portion coupling to said shaft, on one side, and an eccentric pin, on the other side, and a connecting plate disposed between the lower bracket and the upper bracket, wherein said connecting plate includes a first hole through which the eccentric pin passes, and a second hole in which the piston pin is received;

wherein each said upper and lower bracket is a rigid element supporting the plunger at one side of the plunger and having a through opening that accommodates the eccentric pin, the upper and lower brackets being mutually spaced in substantial parallel relation by the piston pin.

2. The compressor according to claim 1, wherein said rotating body is externally provided with a shaped sleeve, coaxial with said tubular portion, able to balance the weight of said tubular portion with respect to said eccentric pin during the rotation of said rotating body.

3. The compressor according to claim 1, wherein said plunger is a first plunger, further comprising a second plunger that is opposed to and coaxial with the first plunger and is supported by said upper bracket and said lower bracket.

4. The compressor according to claim 1, wherein a head of said connecting plate is disposed in communication with the through opening in said lower bracket, and a small end of said connecting plate is coupled with the piston pin through the interposition of a ball bearing.

5. The compressor according to claim 1, wherein the plunger comprises a pair of mutually opposed and coaxial plungers, supported by said lower bracket and said upper bracket, said brackets being coupled with said pair of plungers at peripheral edges of said pair of plungers.

6. The compressor according to claim 1, wherein said plunger is provided with a perimetral sealing element, protruding from a lateral edge of said plunger and maintained in a steady position by a covering disk mounted in a depression located on an outer wall of said plunger.

7. The compressor according to claim 6, wherein said covering disk is made integral with said plunger through a fastener.

8. The compressor according to claim 1, further comprising a shaped base which supports said plunger.

9. The compressor according to claim 8, further comprising a collection chamber for compressed air, provided with at least an inlet for said compressed air in communication with said compression chamber of said cylinder and with at least an outlet for said compressed air in communication with space outside said collection chamber.

10. The compressor according to claim 9, wherein said collection chamber consists of a tubular structure which externally limits said driving element and said shaped base.

11. The compressor according to claim 9, wherein said inlet is provided with a valve opened during a compression stroke and closed during an induction stroke.

12. The compressor according to claim 11, wherein said valve is an annular foil.

13. The compressor according to claim 11, further comprising at least a head, externally applied to said base through fastening means, to be disposed to cover said cylinder.

14. The compressor according to claim 13, wherein said head has at least a through hole for sucking air to be compressed in said cylinder.

15. The compressor according to claim 14, further comprising a flexible thin blade, coupled with the inner wall of said head, said inner wall being turned toward said cylinder and said flexible thin blade being blocked at the ends by placing the peripheral edge of said cylinder close to said head.

16. The compressor according to claim 15, wherein said thin blade is disposed near said through hole, to close said through hole during the compression stroke and to open it during the induction stroke.

17. The compressor according to claim 8, further comprising at least two wheels joined to said shaped base.

18. The compressor according to claim 8, further comprising a handle element available to a user, joined to said shaped base.

* * * * *